US005872088A

United States Patent [19]

Pucci et al.

[11] Patent Number: 5,872,088

[45] Date of Patent: Feb. 16, 1999

[54] SELF-THICKENED CLEANING COMPOSITIONS

[75] Inventors: Maurizio Pucci, Naples; Dario Rapisarda, Rome; Laura Orlandini, Bacoli, all of Italy

[73] Assignee: The Procter & Gamble Company, Cincinnati, Ohio

[21] Appl. No.: 960,402

[22] Filed: Oct. 29, 1997

[51] Int. Cl.[6] ..... C11D 17/00; C11D 3/43; C11D 3/44; C11D 10/02

[52] U.S. Cl. ..... 510/238; 510/403; 510/423; 510/424; 510/427; 510/432; 510/433; 510/434; 510/505; 510/506

[58] Field of Search ..... 510/238, 406, 510/421, 423, 424, 427, 432, 433, 434, 403, 404, 505, 506

[56] References Cited

U.S. PATENT DOCUMENTS

| | | | |
|---|---|---|---|
| 4,414,128 | 11/1983 | Goffinet | 510/405 |
| 4,676,920 | 6/1987 | Culshaw | 510/396 |
| 4,767,563 | 8/1988 | De Buzzaccarini | 510/397 |
| 5,051,212 | 9/1991 | Culshaw et al. | 510/398 |
| 5,202,050 | 4/1993 | Culshaw et al. | 134/42 |
| 5,536,438 | 7/1996 | Scialla et al. | 510/372 |
| 5,559,091 | 9/1996 | Geboes et al. | 510/422 |
| 5,656,580 | 8/1997 | Carrie et al. | 510/362 |
| 5,707,948 | 1/1998 | Evers et al. | 510/217 |
| 5,733,859 | 3/1998 | Carrie et al. | 510/362 |

FOREIGN PATENT DOCUMENTS

| | | |
|---|---|---|
| 0 518 401 A1 | 12/1992 | European Pat. Off. . |
| 0 518 401 B1 | 12/1992 | European Pat. Off. . |

*Primary Examiner*—Ardith Hertzog
*Attorney, Agent, or Firm*—Richard S. Echler, Sr.; Brian M. Bolam; Kim William Zerby

[57] ABSTRACT

The compositions described herein are hard surface cleaning compositions which are viscous but at the same time easy to rinse. Such compositions are formulated by using (a) a linear C6–C16 alcohol and/or linear alkoxylated C6–C16 alcohol, (b) a hydrotropic solvent and (c) an anionic surfactant selected from the group consisting of linear and branched alkyl sulfate, linear and branched alkyl sulfonate and mixtures thereof.

4 Claims, No Drawings

SELF-THICKENED CLEANING COMPOSITIONS

TECHNICAL FIELD

The present invention relates to liquid compositions for cleaning hard surfaces. More particularly, the present invention relates to self-thickened aqueous cleaning compositions.

BACKGROUND OF THE INVENTION

It is well-known in the art that it is a desirable feature of a liquid hard surface cleaning composition that it should have a certain viscosity. Indeed, viscosity allows a controlled handling, more specifically dispensing of the composition during use, as compared to a thinner composition. Also, viscosity allows a better action of the composition on non-horizontal surfaces, such as toilets, bath tubs and the like. That is because viscosity prevents the composition from running down said surfaces, like thinner liquid compositions would.

Preferably, viscosity will be built up by a so-called "self-thickening system" as opposed to using a thickener for that specific purpose. Indeed, thickeners, such as gums or polymers have at least one drawback that they affect the formula cost, while providing only one benefit, which is thickening. They do not participate to the actual cleaning of the surface and therefore represent "inert" materials. Also, some thickeners are detrimental to the physical stability of the liquid compositions they are formulated in. It is known in the art to formulate self-thickened liquid compositions where the thickening is achieved without the use of polymeric thickeners, see for instance WO 95/03383.

WO 95/03302 discloses an aqueous viscous composition (pH=0.5–7) comprising an amine oxide or amine and a secondary or primary monobranched alkyl sulfate or sulfonate, a hydrotrope and an organic acid.

However, there is still a need to provide self-thickened aqueous compositions with better performance in several respects including cleaning performance like grease cleaning performance and viscosity properties.

It is thus an object of the present invention to provide an aqueous hard-surface cleaning composition which is viscous by means of a self-thickening system and which delivers improved cleaning performance.

Also, there are some drawbacks associated with viscosity. And a main drawback is that viscous compositions are typically difficult to rinse away, specifically because viscous compositions have a good cling onto surfaces and current self-thickening systems lead to the formation of stable foams. Thus, viscosity and ease of rinsing are somewhat conflicting requirements, but both are desirable in a single-composition for cleaning hard surfaces.

It is thus another object of the present invention to provide an aqueous hard-surface cleaning composition which is viscous by means of a self-thickening system, and which is nevertheless easy to rinse away.

It has now been found that the above objects can be met by combining (1) a linear C6–C16 alcohol and/or a linear alkoxylated C6–C16 alcohol, (2) hydrotropic solvent and (3) an anionic surfactant selected from the group consisting of a linear and branched alkyl sulfate, a linear and branched alkyl sulfonate and mixtures thereof. Indeed, it has been found that the compositions of the present invention comprising a linear C6–C16 alcohol and/or a linear alkoxylated C6–C16 alcohol, said hydrotropic solvent and said anionic surfactant deliver excellent viscosity properties and improved cleaning performance as compared to the same compositions containing amine oxide surfactants instead of said linear C6–C16 alcohol and/or linear alkoxylated C6–C16 alcohol. More particularly, excellent viscosity properties are achieved even at lower total level of self-thickening ingredients.

An advantage of the viscous compositions according to the present invention that deliver improved cleaning performance is that they may be used in a wide range of applications in bathrooms, kitchens, floors and especially on any vertical surface like walls, toilet bowls and the like.

An additional benefit derived from said compositions is that they are low foaming, both in the sense of the amount of foam initially generated during use, as well as in terms of foam stability. This benefit adds to the ease of rinsing benefit already obtained with the "mechanistic" benefit derived from the viscosity profile of the composition.

Yet another advantage of the compositions of the present invention is that they are physically stable upon long storage periods.

Actually, the present invention provides a cost effective hard surface cleaning composition that meets consumer needs concerning viscosity, rinse ease, cleaning performance and stability upon long storage periods.

BACKGROUND ART

WO 94/13769 discloses self-thickened acidic aqueous compositions comprising an acid and a mixture of a nonionic surfactant with a cationic surfactant as the thickening system. No linear C6–C16 alcohols/linear alkoxylated C6–C16 alcohols and hydrotropic solvents according to the present invention are disclosed in WO 94/13769.

WO 92/05237 discloses acidic aqueous compositions comprising (a) a mixture of nonionic and zwitterionic surfactants, (b) hydrophobic solvents (1%–15%) like butoxy propanol solvent, alkyl and cycloalkyl hydrocarbons and halohydrocarbons, alpha olefins, benzyl alcohol, glycol ethers and diols containing from 6 to 16 carbon atoms, (c) a polycarboxylate detergent builder (e.g. citric acid) and the balance being an aqueous solvent system (0.5%–10%) like methanol, ethanol, and isopropanol. These compositions may optional comprise anionic surfactants (0.001%–5%).

SUMMARY OF THE INVENTION

The present invention is an aqueous viscous composition comprising from 0.1% to 20% by weight of the total composition of a linear alcohol according to the formula R—OH wherein R is a linear hydrocarbon chain of from 6 to 16 carbon atoms and/or a linear alkoxylated alcohol according to the formula $R_1(A)_nOH$, wherein $R_1$ is a linear C6 to C16 hydrocarbon chain, A is ethylene oxide and/or propylene oxide and n is an integer from 1 to 3, from 0.1% to 20% by weight of the total composition of a hydrotropic solvent, and an anionic surfactant selected from the group consisting of linear and branched alkyl sulfate, linear and branched alkyl sulfonate and mixtures thereof.

DETAILED DESCRIPTION OF THE INVENTION

As a first essential ingredient, the compositions herein comprise a linear alcohol according to the formula R—OH wherein R is a linear hydrocarbon chain having from 6 to 16 carbon atoms, preferably from 6 to 14 and more preferably from 8 to 12 carbon atoms and/or a linear alkoxylated alcohol according to the formula $R_1(A)_nOH$, wherein $R_1$ is a linear C6 to C16 hydrocarbon chain, preferably a C8 to C14 hydrocarbon chain and more preferably a C8 to C12 hydrocarbon chain, A is ethylene oxide and/or propylene oxide and n is an integer from 1 to 3, preferably 1.

Particularly preferred linear alcohols to be used herein include 1-octanol, nonilic alcohol, 1-decanol, 1-undecanol, 1-dodecanol, 1-tetradecanol and mixtures thereof, and more preferred are 1-octanol, 1-nonanol, 1-decanol, 1-undecanol, 1-dodecanol and mixtures thereof.

Suitable linear alcohols to be used herein are commercially available under the series Dobanol® from Shell, or Lutensol® from BASF with a wide variety of chain length. For example, a mixture of 1-nonanol and 1-undecanol may be available from Shell under the name Dobanol® 91. A mixture of 1-heptanol and 1-nonanol may be available from Shell under the name Dobanol® 79. A mixture of 1-octanol and 1-decanol may be available from Condea-Visa under the name Nafoll® 810D. A mixture of 1-decanol and 1-dodecanol may be available from Condea Visa under the name Alfol® 10–12. Particularly preferred linear alkoxylated alcohols to be used herein include mixtures of 1-nonanol and 1-undecanol, both singularly alkoxylated, or mixtures of 1-heptanol and 1-nonanol, both singularly alkoxylated.

Suitable linear alkoxylated alcohols to be used herein are commercially available under the series Dobanol® from Shell, or Lutensol® from BASF with a wide variety of chain length and alkoxylation degrees. For example a mixture of 1-nonanol and 1-undecanol, both singularly alkoxylated, and a mixture of 1-heptanol and 1-nonanol, both singularly alkoxylated are commercially available from Shell under the name Dobanol® 91-1 and Dobanol® 79-1.

Typically, the compositions of the present invention comprise from 0.1% to 20% by weight of the total composition of said linear alcohol, linear alkoxylated alcohol or mixtures thereof, preferably from 0.5% to 10%, more preferably from 0.5% to 4% and most preferably from 1% to 3%.

As a second essential ingredient, the compositions herein comprise a hydrotropic solvent or mixtures thereof.

By "hydrotropic solvents" it is meant herein a solvent which helps solubilizing the linear C6–C16 alcohols and/or linear alkoxylated C6–C16 alcohols in the compositions of the present invention. Indeed, the hydrotropic solvents suitable to be used according to the present invention have the ability to provide more homogenous compositions. Typically, the homogeneity of the composition can be evaluated by visual grading and or by a turbidity measurement (Colorquest II). We have found that the hydrotropic solvent participates to the building of the viscosity and contributes to increase the stability of the composition.

Suitable hydrotropic solvents for use herein include ethers and diethers having from 4 to 14 carbon atoms, preferably from 6 to 12 carbon atoms, and more preferably from 8 to 10 carbon atoms, glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols to be used herein are according to the formula HO—CR1R2—OH wherein R1 and R2 are independently H or a C2–C10 saturated or unsaturated aliphatic hydrocarbon chain and/or cyclic. Suitable glycols to be used herein are dodecaneglycol and/or propanediol.

Suitable alkoxylated glycols to be used herein are according to the formula R—(A)n—R1—OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula $R\ (A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols to be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols to be used herein are according to the formula $R\ (A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear C1–C5 alcohols to be used herein are according to the formula $R\ (A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear C1–C5 alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear C1–C5 alcohols to be used herein are according to the formula R—OH wherein R is a linear saturated or unsaturated alkyl group of from 1 to 5 carbon atoms, preferably from 2 to 4. Suitable linear C1–C5 alcohols are ethanol, propanol or mixtures thereof.

Other suitable hydrotropic solvents include butyl diglycol ether (BDGE), butyltriglycol ether, ter amilic alcohol and the like. Particularly preferred hydrotropic solvents to be used herein are butoxy propoxy propanol, ter amilic alcohol, benzyl alcohol, butoxypropanol and mixtures thereof.

The amount of hydrotropic solvent may vary, depending on the amount of linear C6–C16 alcohols and/or linear alkoxylated C6–C16 alcohol. Typically, the compositions of the present invention comprise from 0.1% to 20% by weight of the total composition of a hydrotropic solvent or mixtures thereof, preferably from 0.5% to 10% by weight and more preferably from 1% to 8%.

As a third essential ingredient, the compositions herein comprise an anionic surfactant selected from the group consisting of linear and branched alkyl sulfate, linear and branched alkyl sulfonate and mixtures thereof. These anionic surfactants can be used in the form of their sodium, potassium or alkanolammonium salts.

By "linear alkyl sulfate or sulfonate" it is meant herein a non-substituted alkyl sulfate or sulfonate wherein the alkyl chain comprises from 6 to 18 carbon atoms, preferably from 10 to 16 carbon atoms, and more preferably from 12 to 15 carbon atoms, and wherein this alkyl chain is sulfated or sulfonated at one terminus.

By "branched sulfonate or sulfate", it is meant herein an alkyl chain having from 6 to 18 total carbon atoms, preferably from 10 to 15 carbon atoms, wherein the main alkyl chain is substituted by at least another alkyl chain, and wherein the alkyl chain is sulfated or sulfonated at one terminus.

Particularly preferred branched alkyl sulfate to be used herein are those containing from 10 to 14 carbon atoms like Isalchem 123®. Isalchem 123® commercially available from Enichem is a C12–13 surfactant which is 94% branched. This material can be described as $CH_3$—$(CH_2)_m$—$CH(CH_2OSO_3Na)$—$(CH_2)_n$—$CH_3$ where n+m=8–9. Also preferred branched alkyl sulfate are the alkyl sulfate where the alkyl chain comprises a total of 12 carbon atoms, i.e., sodium 2-butyl octyl sulfate. Such alkyl sulfate is commercially available from Condea under the trade name Isofol® 12S. Particularly suitable linear alkyl sulfonate include C12–C16 paraffin sulfonate like Hostapur® SAS commercially available from Hoechst. Highly preferred to be used herein is a combination of the Isalchem 123® or Hostapur SAS® with a linear C8–C14 alkyl Sulfate like Empicol C10 AS® available from A&W.

Typically, the compositions of the present invention comprise from 0.1% to 20% by weight of the total composition of said anionic surfactant or mixtures thereof, preferably from 1% to 10%, more preferably from 1% to 6% and most preferably from 2% to 5%.

It has now been found that by combining the linear C6–C16 alcohol and/or linear alkoxylated C6–C16 alcohol and the hydrophobic solvent with the anionic surfactant as described herein, in an aqueous composition, improved cleaning performance as well as excellent viscosity properties are provided to said composition, said composition being also easily rinsed away.

By "improved cleaning performance" it is meant herein that the cleaning performance delivered by a liquid composition comprising the linear C6–C16 alcohol and/or linear alkoxylated C6–C16 alcohol, said hydrophobic solvent and said anionic surfactant is improved, as compared to the cleaning performance delivered by the same composition comprising only one or two of said ingredients.

The cleaning performance may be evaluated by the following test method. Artificial soil composition, e.g., a suspension containing artificial body soil (grease, skin residues, cholesterol and the like), oils and carbon black, may be used. The soil suspension is sprayed onto one tile at a time in four passes, repeat once, taking care to keep swirling the suspension to avoid settling. 0.3 g of soil is deposited on each tile. The soiled tiles are then baked in a preheated convection oven at 140° C. for a period of 30 minutes. The tiles are held on a Sheen Wet Abrasion Scrub Tester® in a holding plate which leaves the tiles slightly raised above the surface. The compositions according to the present invention and the reference composition (e.g., 0.3 ml) are independently applied to a Spontex® sponge held on the scrub tester. The sponge is then passed on the soiled tiles to clean them. The number of strokes required to completely clean the tiles are recorder. The lower the number of strokes recorded the better the cleaning performance.

Ease of rinsing can be evaluated by the following test method. The composition to test is diluted with water (1.2% by weight) to form a solution. The foam height (e.g., in cm) generated after a sponge is soaked and squeezed in the resulting solution 10 times is recorded, as well as the rate of foam collapse (e.g., cm/min). Foam height and rate of foam collapse are indicative of ease of rinsing.

It is speculated that the anionic surfactant, the hydrotropic solvent and the linear C6–C16 alcohol and/or linear alkoxylated C6–C16 alcohol self assemble into worm-like micelles. Some of these worm-like micelles may be branched so as to form an interconnected micellar network. It is believed that the formation of such worm-like micelles (also called treadlike micelles) is responsible for the viscosity properties delivered to an aqueous composition comprising them. Indeed, in absence of the linear C6–C16 alcohol and/or linear alkoxylated C6–C16 alcohol the aqueous composition contains spherical micelles, as opposed to worm-like micelles, and the viscosity of said composition is close to that of water. The compositions according to the present invention are clear as opposed to opaque.

Such worm-like micelles may be identified in the compositions of the present invention by Cryo-transmission electron microscopy (Cryo-TEM). Cryo-TEM samples are prepared in a controlled environment vitrification system (CEVS) which is described in detail in Bellare, J. R.; Davis, H. T.; Scriven, L. E.; Talmon, Y., Controlled environment vitrification system (CEVS): An improved sample preparation technique, J. Electron Microsc. Tech., 1988, 10, 87–111. A 5 l drop of the sample is placed on a carbon-coated holey polymer support film mounted on the surface of a standard 300-mesh TEM grid (Ted Pella, Inc., Catalog #01883). The drop is blotted with filter paper until it was reduced to a thin film (10–200 nm) of the sample spanning the holes (2–8 m) of the support film. The sample is then vitrified by rapidly plunging it through a synchronous shutter at the bottom of the CEVS into liquid ethane at its freezing point. The vitreous specimen is transferred under liquid nitrogen into a Philips CM12 microscope for imaging. The temperature of the sample is kept under −170° C. throughout the examination.

The compositions herein have a viscosity of from 10 cps to 5000 cps, when measured at 60 RPM shear rate with a Brookfield viscometer spindle #2 at 20° C., preferably from 50 cps to 400 cps and more preferably from 100 cps to 300 cps.

The compositions of the present invention are physically stable. By "physically stable" it is meant herein that no phase separation occurs for a period of 10 days at 50° C.

The compositions according to the present invention are aqueous compositions. Therefore they comprise from 90% to 60% by weight of the total composition of water, preferably from 90% to 75% and more preferably from 90% to 80%. One of the achievements of the present invention is that the viscosity build up described hereinafter can be achieved with such a high amount of water, i.e., a small amount of actives.

The compositions according to the present invention may be formulated in a wide range of pH, typically from 0 to 13. Indeed, the desired self-thickening properties can be achieved in these pH range. Particularly preferred compositions herein are formulated in a pH range from 0.5 to 7. A preferred pH range herein is from 1 to 5, more preferably from 2 to 4.

Thus, the compositions of the present invention may further comprise an acid, or mixtures thereof. Preferably, the acids for use herein will have a pK of less than 6. Suitable acids to be used herein include organic and inorganic acid. For example suitable organic acids to be used herein may be selected from the group consisting of citric acid, lactic acid, glycolic acid, succinic acid, glutaric acid, adipic acid, and mixtures thereof. A mixture of said acids suitable for use herein is commercially available from BASF under the trade name of Sokalan® DCS. A preferred acid for use herein is citric acid. Such acids participate to the cleaning benefits of the compositions herein especially they deliver limescale removal properties to said compositions.

The amount of acid herein may vary, depending on the amount of other ingredients herein, but suitable amounts of acids herein are generally up to 25% by weight of the total composition, preferably between 0.5% and 20%, more preferably between 2% and 15%.

As an optional but highly preferred ingredient, compositions herein will comprise a perfume ingredient, usually a mixture of such ingredients. By "perfume", it is meant herein constituents of a perfume which are added thereto only or primarily for their olfactive contribution. Perfume components may be natural products such as essential oils, absolutes, resinoids, resins, concretes, etc., and synthetic perfume components such as hydrocarbons, alcohols, aldehydes, ketones, ethers, acids, acetals, ketals, nitrites, etc., including saturated and unsaturated compounds, aliphatic, carbocyclic and heterocyclic compounds. Examples of such perfume components are: geraniol, geranyl acetate, linalool, linalyl acetate, tetrahydrolinalool, citronellol, citronellyl acetate, dihydromyrcenol, dihydromyrcenyl acetate, tetrahydromyrcenol, terpineol, terpinyl acetate, nopol, nopyl acetate, 2-phenylethanol, 2-phenylethyl acetate, benzyl alcohol, benzyl acetate, benzyl salicylate, benzyl benzoate, styrallyl acetate, amyl salicylate, dimenthylbenzylcarbinol, trichloromethylphenycarbinyl acetate, p-tert.butyl-cyclohexyl acetate, isononyl acetate, vetiveryl acetate, vetiverol, alpha-n-amylcinammic aldehyde, alphahexyl-cinammic aldehyde, 2-methyl-3-(p-ter.butylphenyl)-propanal, 2-methyl-3(p-isopropylpheny) propanal, 3-(p-tert.butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3cyclohexenecarbaldehyde, 4-acetoxy-3-pentyltetrahhydropyran, methyl dihydrojasmonate, 2-n-heptylcyclopentanone, 3-methyl-2-pentylcyclopentanone, n-decanal, n-dodecanal, 9-decenol-1, phenoxyethyl isobutyrate, phenylacetaldehyde dimenthyl acetal, phenylacetaldehyde dietyll acetal, geranonitrile, citronellonitrile, cedryl acetate, 3-isocamphylcyclohexanol, cedryl ether, isolongifolanone, aubepine nitrile, aubepine, heliotropine, coumarin, eugenol, vanillin, diphenyl oxide, hydroxycitronellal, ionones, methyl ionones, isomethyl ionones, irones, cis-3-hexenol and esters thereof, indane musks, tetralin musks, isochroman musks, macrocyclic ketones, macrolactone musks, ethylene brassylate, aromatic nitromusk.

Compositions herein may typically comprise from 0.1% to 4% by weight of the total composition of a perfume ingredient, or mixtures thereof, preferably from 0.1% to 1.0%.

The compositions herein may comprise a variety of other ingredients, including further actives as well as more aesthetical ingredients such as dyes and the like. In particular the rheology of the compositions herein would be suitable for suspending particles in the composition, e.g. particles of abrasives.

The compositions according to the present invention may comprise other surfactants or mixtures thereof. Surfactants for use herein are those well-known in the art and include anionic, nonionic, zwitterionic, amphoteric and cationic surfactants and mixtures thereof.

Particularly suitable surfactants to be used herein are amine oxide surfactants according to the formula R1R2R3NO, wherein each of R1, R2 and R3 is independently a saturated substituted or unsubstituted, linear or branched alkyl groups of from 1 to 30 carbon atoms, preferably of from 1 to 20 carbon atoms, and mixtures thereof.

Particularly preferred amine oxide surfactants to be used according to the present invention are amine oxide surfactants having the following formula $R_1R_2R_3NO$ wherein R1 is a saturated linear or branched alkyl group of from 1 to 30 carbon atoms, preferably of from 6 to 20 carbon atoms, more preferably of from 6 to 16 carbon atoms, and wherein R2 and R3 are independently substituted or unsubstituted, linear or branched alkyl groups of from 1 to 4 carbon atoms, preferably of from 1 to 3 carbon atoms, and more preferably are methyl groups.

Suitable amine oxide surfactants for use herein are for instance C8 amine oxide, C10 amine oxide, C14 amine oxide, natural blend C8–C10 amine oxides as well as natural blend C12–C16 amine oxides. Such amine oxide surfactants may be commercially available from Hoechst or Stepan.

Said amine oxide surfactants are preferred herein as they further contribute to the outstanding stain removal performance of the compositions herein on various types of stains.

Typically, the compositions herein comprise up to 10% by weight of the total composition of an amine oxide surfactant or mixtures thereof, preferably from 0.1% to 5%, and more preferably from 0.1% to 3%.

The liquid viscous compositions herein may be packaged in a variety of suitable detergent packaging known to those skilled in the art.

In one embodiment of the present invention the liquid viscous compositions herein may desirably be packaged in manually operated spray dispensing containers, which are usually made of synthetic organic polymeric plastic materials. Accordingly, the present invention also encompasses liquid viscous compositions as described herein packaged in a spray dispenser, preferably in a trigger spray dispenser. Indeed, said spray-type dispensers allow to uniformly apply to a relatively large area of a surface to be treated the liquid viscous compositions according to the present invention, thereby contributing to cleaning properties of said compositions. Such spray-type dispensers are particularly suitable to clean vertical surfaces.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. Nos. 4,646,973 and 4,538,745 both to Focarracci. Particularly preferred to be used herein are spray-type dispensers such as T 8500® commercially available from Continental Spray International or T 8100® commercially available from Canyon, Northern Ireland. In such a dispenser, the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e., to help the formation of liquid droplets.

EXAMPLES

The present invention is further illustrated by the following examples. The following compositions are made by mixing the listed ingredients in the listed proportions in the listed order of addition.

| Ingredients | Compositions | | | | | | | | |
|---|---|---|---|---|---|---|---|---|---|
| | I | II | III | IV | V | VI | VII | VIII | IX |
| Citric acid | 3.5 | 3.5 | 3.5 | 3.5 | 5.9 | 4.0 | 3.5 | 3.5 | 3.5 |
| Alkyl sulfate (based on Lial alcohol) | — | — | — | — | — | 5.0 | — | — | — |
| Empicol C10AS ® | — | — | — | 1.0 | — | — | — | 0.5 | 1.0 |
| Alkyl sulfate (based on Isalchem 123 ® alcohol) | 3.5 | 3.5 | — | — | 3.0 | — | 4.0 | — | — |
| Hostapur SAS ® | — | — | 3.5 | 3.5 | — | — | — | 2.0 | 2.0 |
| C8-C18 Amine Oxide | — | — | — | — | — | — | — | — | 0.5 |
| 1-octanol | — | — | 1.5 | 1.5 | — | — | — | — | — |
| Dobanol 91 ® | 1.5 | 1.25 | — | — | — | 1.50 | — | 1.25 | 1.25 |
| Dobanol 79 ® | — | — | — | — | 1.50 | — | — | — | — |
| Alfol 10-12 ® | — | — | — | — | — | — | 1.25 | — | — |
| n-BPP | 1.5 | 1.0 | — | 1.5 | 1.5 | 1.5 | — | 2.2 | — |
| Benzyl Alcohol | — | — | — | — | — | — | — | — | 5.0 |
| Ter-amilic alcohol | — | — | 1.0 | — | — | — | — | — | — |
| Butoxy-propanol | — | — | — | — | — | 1.5 | — | — | — |
| Perfume | 0.40 | 0.40 | 0.44 | 0.44 | 0.44 | 0.40 | 0.40 | 0.41 | 0.6 |
| Minors and water | balance | | | | | | | | |
| Sodium Hydroxide up to pH 3 | | | | | | | | | |
| Viscosity, in cps (60 rpm, spindle #2, Brookfield, 20° C.) | 150 | 110 | 120 | 160 | 105 | 130 | 140 | 95 | 100 |

In the examples hereinabove, Lial alcohol (from Enichem) is C12–15 alcohol, 50% branched and 50% linear. Isalchem 123® (from Enichem), is a C12–13, which is 94% branched. The material can be described as $CH_3$—$(CH_2)$m—$CH(CH_2OSO_3Na)$—$(CH_2)$n—$CH_3$ where n+m=8–9. Hostapur SAS® is C12–16 Sodium paraffin sulfonate. Empicol® C10AS is a linear alkyl sulfate. n-BPP is n-butoxy propoxy propanol. Dobanol 91® is a mixture of 1-nonanol and 1-undecanol. Dobanol 79® is a mixture of 1-heptanol and 1-nonanol. Alfol 10–12® is a mixture of 1-decanol and 1-dodecanol.

All the above compositions are self-thickening aqueous compositions according to the present invention. They exhibit good physical stability. Furthermore, with the compositions formulated in the above examples, there is limited foam generated, and the foam which is generated collapsed quickly, overall providing an easy rinsing.

What is claimed is:

1. A self-thickened aqueous cleaning composition comprising:

a) from 0.1% to 20% by weight of an optionally alkoxylated alcohol selected from the group consisting of:

i) an alcohol having the formula ROH wherein R is $C_6$–$C_{16}$ linear alkyl;

ii) an alkoxy alcohol having the formula $R_1(A)_nOH$ wherein $R_1$ is $C_6$–$C_{16}$ linear alkyl, A is ethyleneoxy, propyleneoxy, or mixtures thereof, n is an integer from 1 to 3; and iii) mixtures thereof;

b) from 0.1% to 20% by weight, of a hydrotropic solvent, said hydrotropic solvent selected from the group consisting of butoxy propoxy propanol, ter-amilic alcohol, butoxypropanol, butyl diglycol ether, butyltriglycol ether, butoxy ethanol, and mixtures thereof;

c) from 0.1% to 20% by weight, of an anionic surfactant, said anionic surfactant selected from the group consisting of $C_6$–$C_{18}$ linear or branched alkyl sulfate, $C_6$–$C_{18}$ linear or branched alkyl sulfonate, and mixtures thereof;

d) from 3.5 to 5.9% by weight, of citric acid; and e) the balance carriers and adjunct ingredients;

provided said composition has a viscosity of from 100 to 300 cps at 20° C. and a pH value of up to 3.

2. A composition according to claim 1 comprising from 1% to 3% by weight, of a $C_8$–$C_{12}$ linear alcohol.

3. A composition according to claim 1 comprising from 1% to 3% by weight, of a $C_8$–$C_{12}$ linear ethoxylated alcohol having from 1 to 3 ethyleneoxy units.

4. A composition according to claim 1 further comprising from 0.1% to 5% by weight, of an amine oxide having the formula $R_1R_2R_3NO$ wherein $R_1$, $R_2$, and $R_3$ are each independently $C_1$–$C_{30}$ linear or branched alkyl.

* * * * *